US006233978B1

(12) United States Patent
Gehring, Jr. et al.

(10) Patent No.: US 6,233,978 B1
(45) Date of Patent: May 22, 2001

(54) POINTED THRUST WEAPONS PROTECTIVE FABRIC SYSTEM

(75) Inventors: George G. Gehring, Jr., Baldwin; Aaron Reisfeld, New Hyde Park, both of NY (US)

(73) Assignee: Gehring Textiles, Inc., New York, NY (US)

( * ) Notice: Subject to any disclaimer, the term of this patent is extended or adjusted under 35 U.S.C. 154(b) by 0 days.

(21) Appl. No.: 09/134,275

(22) Filed: Aug. 14, 1998

Related U.S. Application Data

(63) Continuation-in-part of application No. 09/057,659, filed on Apr. 9, 1998.

(51) Int. Cl.[7] ..... D04B 21/00

(52) U.S. Cl. ..... 66/195

(58) Field of Search ..... 66/169 R, 171, 66/190, 192, 193, 195, 196, 202, 455; 2/2.5, 6.6; 428/911; 89/36.05; 442/304, 305, 312, 313, 314, 318

(56) References Cited

U.S. PATENT DOCUMENTS

| | | | | |
|---|---|---|---|---|
| 4,004,295 | * | 1/1977 | Byrnes, Sr. | 2/16 |
| 4,518,640 | * | 5/1985 | Wilkens | 428/102 |
| 5,415,007 | * | 5/1995 | Eng | 66/192 |
| 5,822,791 | * | 10/1998 | Baris . | |
| 5,858,054 | * | 1/1999 | Rosen | 66/202 |
| 5,887,453 | * | 3/1999 | Woods | 66/171 |

* cited by examiner

*Primary Examiner*—Danny Worrell
(74) *Attorney, Agent, or Firm*—Gottlieb, Rackman & Reisman, P.C.

(57) ABSTRACT

A warp knit fabric for resisting point penetration of thrusting type weapons is provided. The fabric comprises a multiplicity of thread systems made from high performance yarns with a tenacity of 7 gram/denier. Each of the thread systems are produced by front bar guide movement having the formulation of: 1–0/n–(n+1), wherein n is the spaces traversed by the guide bar.

9 Claims, 2 Drawing Sheets

POINTED THRUST WEAPONS PROTECTIVE FABRIC SYSTEM

This application is a continuation in part of Ser. No. 09/057,659 filing date Apr. 4, 1998.

BACKGROUND OF INVENTION

The prison population in the U.S. is now approaching the 2 million mark. With growing prison overcrowding and resultant inmate tensions, the guards and correctional officers are increasingly exposed to stab attacks by violent criminals using a variety of home made thrusting weapons such as shanks, ice picks, knives, sharpened nails or other objects. As these attacks can inflict life-threatening wounds, many guards are now wearing protective suits designed to stop penetration of such weapons. The suits are made with multiple woven fabric layers using high performance, high tenacity yarns.

A typical fabric used is woven with one of the above yarns in a density of 70 picks×70 warp ends/inch. The fabric is coated with a special resin to resist and retard penetration of an ice pick point by preventing the weave components from shifting. About 27 layers or plies of fabric are combined to provide a protective, stab resistant shield placed inside the suit. The suits are tested using the current standard, which stipulates resistance to an impact valve of 81.1 foot-pounds using a 7 inch long pick in a diameter of 0.0163 inch with a 15:1 taper and steel hardness of 42 c, as per the State of California body armor specifications.

Circular weft knit fabrics have also been introduced into this field. They are made on interlock or double knit machines. These fabrics rely on heavy resin impregnation to stabilize or "freeze" the loop components in order to enhance resistance to penetration by a pick or other weapon.

One of the main disadvantages of woven fabrics in offering protection from thrust or stab weapons is the relative ease with which the weft and warp threads slide on each other as the weapon's point impinges on them, pushing them aside, and leading to effective penetration. All woven structures are held together by friction existing between its components and have to use various resins to immobilize them and preserve the fabric integrity as it is impacted by a thrusting point. This makes the fabric heavy, stiff and almost impenetrable to air, leading to wearer discomfort.

Circular knit fabrics, while more permeable to air than woven ones, are inherently unstable due to their residual elasticity, which must be eliminated with the application of a heavy resin coating. Furthermore, circular knit fabrics cannot be made very tight in order to produce a high thread density per unit area. This is because of their rather open loop structure.

For fabrics to be truly effective in resisting point penetrations, it is essential to have a high density of yarn crossings, firmly anchored in the matrix of its structure, and without relying on friction or resin impregnation. Warp knit fabrics satisfy these requirements better than wovens or circular knits.

SUMMARY OF THE INVENTION

A warp knit fabric for resisting point penetration of thrusting type weapons is provided. The fabric comprises a multiplicity of thread systems made from high performance yarns with a minimum tenacity of 7 gram/denier. Each of the thread systems are produced by bar guide movement having the formulation of: 1–0/n–(n+1), wherein n is the spaces traversed by the guide bar.

In one embodiment, a multi-axial warp knit fabric is produced. One thread system comprises vertical warp inlays, while a second comprises horizontal weft inlays. Preferably, a series of diagonal inlay systems are also provided. Significantly, each thread system is disposed one on the other. A loop structure is provided for holding the thread systems together.

The advantages of using warp knits as a point penetration protective medium are as follows:

1) ability to engineer structures with a much higher thread density than possible with either wovens or circular knits.

2) positively locked or anchored structure members, not relying on friction or resin impregnation to preserve its integrity when impacted by a point.

3) facility to use multiple guide bars to produce very dense combination fabrics. Any warp knit structure is the result of two or more sub-structures generated by each guide bar and interknitted with each other as to render a compact, dense product.

4) the thread density may further be enhanced by a technique known as warp and weft insertion where straight lengths of threads are introduced into the structure in the horizontal and vertical directions.

5) warp knit fabrics, because of their system of loops, have a natural air permeability, superior to wovens, which have to be tightly constructed to prevent slippage of their components. The permeability of warp knits enables them to transmit perspiration vapor through the fabric and thus enhance wearing comfort.

6) warp knit fabrics are more pliable and flexible than wovens and tend to conform to the contours of the wearer's body.

Other advantages will be obvious or apparent from the following description.

BRIEF DESCRIPTION OF THE DRAWINGS

For a fuller understanding of the invention, reference is made to the following description, taken in connection with the following drawings.

DETAILED DESCRIPTION OF THE PREFERRED EMBODIMENT

As will be shown, suitably constructed warp knit fabrics will serve as protection against penetration by ice picks or other thrusting weapons. Such a design constitutes a significant improvement over existing woven, circular knit or other fabric systems.

The advantages of warp knit fabrics over other protective materials are:

1) Positively locked or anchored fabric structure members which do not rely on friction or resin impregnation to preserve their integrity when impacted by a point, as is the case with woven or other knit fabrics.

2) Facility to engineer structures with a much higher thread density than possible with other type fabrics. As can be appreciated, the greater the thread density, the more effective penetration stopping powers of the structure.

3) Diverse means of generating high thread density through multiplicity of guide bars, warp and welt insertion and multiaxial technology, unavailable with other fabric forming systems.

4) The multiaxial technology involves up to five systems of threads superimposed on top of each other in a star-like configuration, which enables the fabric structure to have equal strength and penetration resistance in every direction. Both wovens and circular knits have only two systems of threads and their strength is strictly directional.

5) Warp knit fabrics have a natural air permeability, thanks to their loop structure, and superior to wovens, which must be tightly constructed to prevent slippage of their components under the impact of a penetrating point. The air permeability enhances the wearing comfort of the protective suits.

6) Warp knit fabrics are more pliable and flexible than wovens and conform better to the contours of the wearer's body.

7) Warp knits are by nature more rip-resistant than wovens, which is a distinct advantage in penetration by a knife or other bladed weapon.

Figure 1:
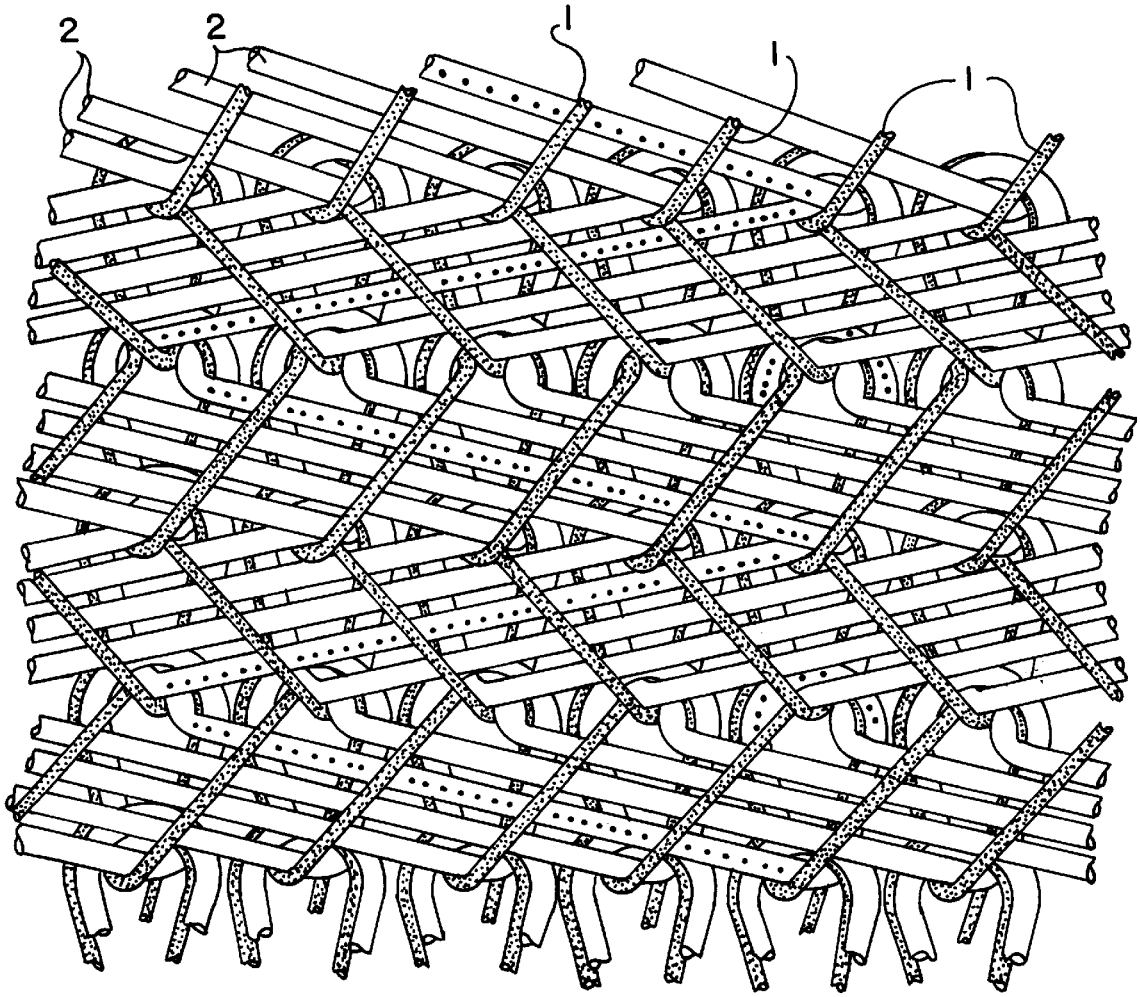
FIG. 1 is a schematic view of the loop configuration of the inventive fabric.

FIG. 1. illustrates schematically the loop configuration in a fabric made in accordance with the invention that is used for protection against stab attacks. The drawing portrays the fabric structure as it appears on the reverse or technical side.

The fabric used is a "high performance" yarn with a tenacity greater than 7 gram/denier. Suitable yarns include such fibers trademarked as DuPont's "Kevlar," AKZO's "Twaron," Teijin's "Technora," all in the Para-Aramid group, Allied-Signal's "Spectra" and the DSM-Toyobo's Dyneema in the ultra high molecular weight polyethylene group and the Hoechst-Celanese's "Vectran," a liquid crystal polymer and Toyobo's PBO fiber known as "Zylon."

The fabric, in one example, is made on a 24 gauge tricot machine using 195 denier Kevlar on both guide bars and knit as tight as the equipment would allow in order to produce maximum thread density per unit area. A Raschel machine could also knit such a fabric, but not as tight because of the peculiarities of its loop forming elements.

The digital guide bar movement notation (as accepted in the industry) for this example is:
Front bar: 1–0/1–2.
Back bar: 4–5/1–0.

The heavy black lines on the diagram show the disposition of front bar threads, while the dotted line traces the paths of the back bar threads. As shown, the black lined threads (1) of the front bar overlay those of the back bar (2) as to immobilize them in their places and thus resist penetration of an ice pick point by not allowing them to shift aside.

Anyone skilled in the art can appreciate that front bar movement may be increased to extend over a longer distance, normally expressed in the needle spaces traversed by the guide bar, like 3, 4 or 5 or even more, in order to increase thread density of the structure per unit area.

The general formula for front guide bar movement may be written as follows: 1–0/n–(n+1), where n is the spaces traversed by the guide bar.

Each guide bar may produce such stitches as chaining (1–0, 0–1) , inlays (O–0, 2–2) and the like, warp inlays (0–0, 0–0), or combinations and permutations thereof. Horizontal weft insertion may also be used.

In order to boost thread density of the fabric structure, one could use an additional guide bar or two, each bar making its own contribution and adding to the total sum of threads per unit area.

Preferably, thread density must be at least 7,500 threads/sq. inch.

Figure 2:
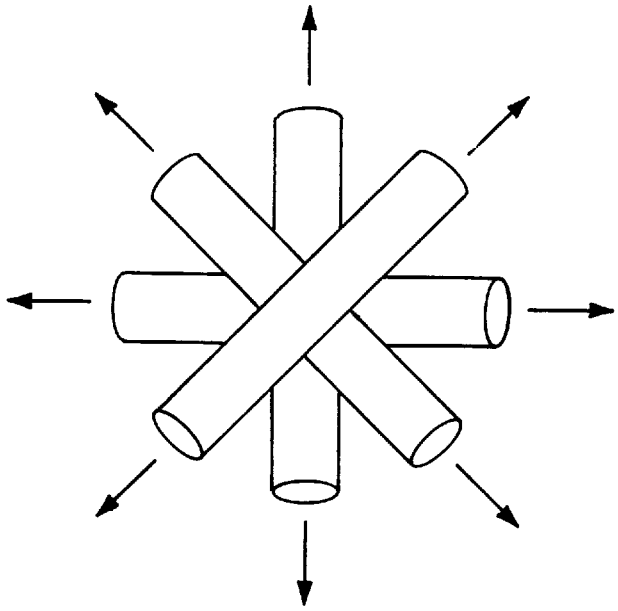
FIG. 2 is a schematic view showing one embodiment of the thread systems of the invention.

Good ice pick penetration stopping performance may be obtained with the aid of multiaxial technology, which arrays the thread systems in a star-like configuration, as illustrated on FIG. 2. This provides the fabric structure with equal strength and penetration resistance in every direction, which is certainly a desirable feature in a protective suit.

Figure 3:
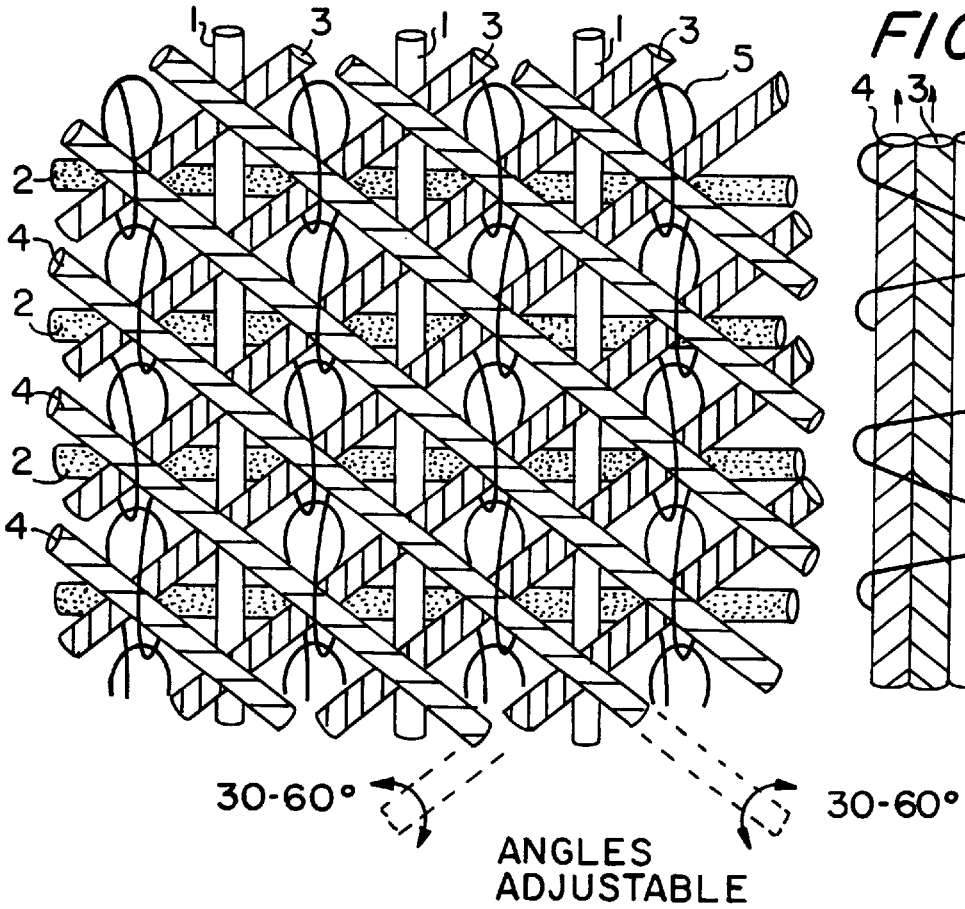
FIG. 3 is a more detailed schematic view showing the second embodiment of the thread system of the invention.
Figure 3A:
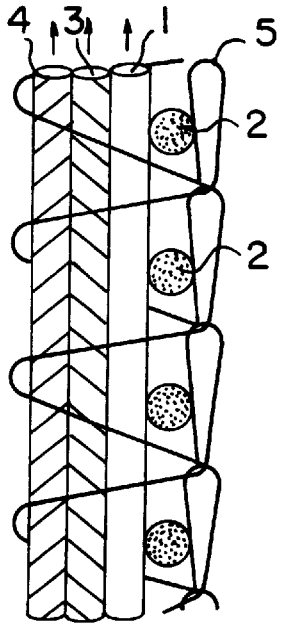
FIG. 3A is a cross-sectional view of the fabric depicted in FIG. 3.

Because of the balanced construction of the fabric, an ice pick point is restrained simultaneously by all 5 thread systems, as shown on FIG. 3. Threads 1 are the vertical warp inlays. Threads 2 are the horizontal weft inlays. Threads 3 and 4 are the diagonal inlays. Threads 5 are formed into a loop structure, which holds the entire system of 4 inlays locked together into an integral fabric featuring considerable thread density and integrity. FIG. 3A depicts the cross-section of the structure along its vertical axis in which all the inlay threads are superimposed on top of each other and bound into a coherent bundle by the loop members of threads 5. The inclination of threads 3 and 4 may be set in the 30 to 60 angle range.

It should be pointed out here that superimposing the four thread systems in a parallel-like configuration utilizes their entire tenacity strength, unlike in woven fabrics where the threads are interlaced and crimped, which reduces their strength and imposes a harmful shearing stress when the fabric is impacted.

Any warp knit machine in suitable gauge and fitted with 5 guide bars may be used to simulate the multiaxial structure through appropriate knitting technique; a system of diagonal, horizontal and vertical inlays held together in a matrix of loops may thus be produced.

In some cases, it may be advantageous to apply certain post-knitting processing in order to enhance the fabric resistance to penetration by the point of a thrusting weapon. Such processing may involve the following:

1. Calendaring: This process is based on flattening the fabric between two or more steel rolls under the application of heat and pressure. The calendared fabric is substantially compacted, which boosts its resistance to penetration.

2. Lamination: The fabric may be laminated or bonded to another fabric or substrate to make it more resistant to penetration.

3. Resin Coating: The fabric may be coated or impregnated with a resin or substance which increases the coefficient of friction between the fabric and the point of a thrusting weapon as to retard its penetration through the protective garment.

What is claimed is:

1. A protective fabric that resists penetration by a sharp object, said fabric comprising:

a plurality of thread systems formed of high performance yarns having a tenacity of at least 7 grams/denier, said yarns being warp knit to form a structure having a thread density of at least 7,500 threads/sq. in. wherein said thread systems are interlocked during the knitting process to prevent sliding between the threads when the sharp object is pushed into the fabric.

2. The protective fabric of claim 1 wherein said yarns system are produced by guide bar movement in accordance with the formula 1–0/n–(n+1).

3. The protective fabric of claim 1 wherein said yarns are made of a fabric selected from a para-amid group, an ultra high molecular weight polyethylene group and a liquid crystal polymer.

4. A method of making a protective fabric that resists penetration by a sharp object comprising:

providing a plurality of high performance yarns having a tenacity of at least 7 grams/denier; and warp knitting said yarns to form a fabric layer having thread systems with a thread density of at least 7,500 threads/sq.in., wherein during said warp knitting the threads of the fabric layer are interlocked to resist penetration by the sharp object.

5. The method of claim 4 wherein said warp knitting is performed using a guide bar movement defined by the formula 1–o/n–(n+1).

6. The method of claim 4 wherein said yarns are selected from the group consisting of a para-amid, an ultra high molecular weight polyethylene and a liquid crystal polymer.

7. The method of claim 4 further comprising calendering said fabric layer.

8. The method of claim 4 further comprising laminating said fabric layer to another fabric.

9. The method of claim 8 further comprising applying a resin coating to said fabric layer.

* * * * *